US012492607B2

(12) United States Patent
Sonat et al.

(10) Patent No.: US 12,492,607 B2
(45) Date of Patent: Dec. 9, 2025

(54) HYDRATED METAL CARBONATE FOR CARBON CAPTURE AND UNDERGROUND STORAGE

(71) Applicant: Halliburton Energy Services, Inc., Houston, TX (US)

(72) Inventors: Cem Sonat, Singapore (SG); Michael Linley Fripp, Singapore (SG); Mathusan Mahendran, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 50 days.

(21) Appl. No.: 18/078,552

(22) Filed: Dec. 9, 2022

(65) Prior Publication Data

US 2024/0191591 A1 Jun. 13, 2024

(51) Int. Cl.
*E21B 33/12* (2006.01)
*E21B 41/00* (2006.01)

(52) U.S. Cl.
CPC ..... *E21B 33/1208* (2013.01); *E21B 41/0064* (2013.01)

(58) Field of Classification Search
CPC ..... E21B 33/1208; E21B 33/1212; E21B 33/1277; E21B 33/128; E21B 43/103; E21B 43/105; E21B 43/106; E21B 43/108
See application file for complete search history.

(56) References Cited

U.S. PATENT DOCUMENTS

| | | | | |
|---|---|---|---|---|
| 10,961,804 | B1 | 3/2021 | Fripp et al. | |
| 11,448,042 | B1 | 9/2022 | Glaesman et al. | |
| 11,454,083 | B2 | 9/2022 | Asthana et al. | |
| 11,634,962 | B1 * | 4/2023 | Glaesman | E21B 33/124 166/387 |
| 2007/0056735 | A1 | 3/2007 | Bosma et al. | |
| 2011/0132611 | A1 | 6/2011 | Rytlewski et al. | |
| 2013/0056209 | A1 | 3/2013 | Mazyar et al. | |
| 2016/0137912 | A1 * | 5/2016 | Sherman | C09K 8/80 166/243 |
| 2016/0230062 | A1 | 8/2016 | Beuterbaugh et al. | |
| 2016/0273299 | A1 | 9/2016 | Fripp et al. | |
| 2017/0138149 | A1 * | 5/2017 | Muthusamy | C08F 220/68 |
| 2018/0078998 | A1 * | 3/2018 | Sherman | B22F 1/062 |

(Continued)

FOREIGN PATENT DOCUMENTS

| | | |
|---|---|---|
| WO | 2018085102 A1 | 5/2018 |
| WO | 2019094044 | 5/2019 |
| WO | 2019164499 | 8/2019 |

OTHER PUBLICATIONS

International Search Report and Written Opinion for International Patent Application No. PCT/US2022/054391 dated Aug. 29, 2023.

(Continued)

*Primary Examiner* — Angela M DiTrani Leff
(74) *Attorney, Agent, or Firm* — Scott Richardson; C. Tumey Law Group PLLC

(57) ABSTRACT

Systems and methods of the present disclosure relate to storing carbon dioxide ($CO_2$) underground. A method includes contacting a metal tool with the $CO_2$ and forming hydrated metal carbonates (HMCs) on the tool due to contact of the $CO_2$ with the metal of the tool. Expansion of the tool occurs due to formation of the HMCs.

11 Claims, 6 Drawing Sheets

(56) References Cited

U.S. PATENT DOCUMENTS

| | | | | |
|---|---|---|---|---|
| 2020/0080401 | A1* | 3/2020 | Sherman | E21B 43/086 |
| 2021/0332659 | A1* | 10/2021 | Fripp | E21B 33/1208 |
| 2022/0178222 | A1 | 6/2022 | Fripp et al. | |
| 2022/0205341 | A1 | 6/2022 | Asthana et al. | |
| 2022/0205470 | A1 | 6/2022 | Asthana et al. | |
| 2023/0265736 | A1* | 8/2023 | Stam | E21B 33/1208 166/387 |

OTHER PUBLICATIONS

Netherlands Search Report and Written Opinion for NL Patent Application No. 2036183 dated Nov. 17, 2024. English Machine Translation with Original Untranslated Version, PDF file. 16 pages.

* cited by examiner

HYDRATED METAL CARBONATE FOR CARBON CAPTURE AND UNDERGROUND STORAGE

BACKGROUND

Carbon capture and underground storage (CCUS) is a process in which carbon dioxide ($CO_2$) is captured and sequestered before it enters the atmosphere. The $CO_2$ is transported and stored (carbon sequestration) in a subterranean geological formation. Typically, the $CO_2$ is captured from a chemical plant or a biomass power plant, and then stored underground. Accordingly, effective seals and anchors that are robust for environments rich in carbon dioxide are desired.

BRIEF DESCRIPTION OF THE DRAWINGS

These drawings illustrate certain aspects of some examples of the present disclosure and should not be used to limit or define the disclosure.

DETAILED DESCRIPTION

Figure 1:
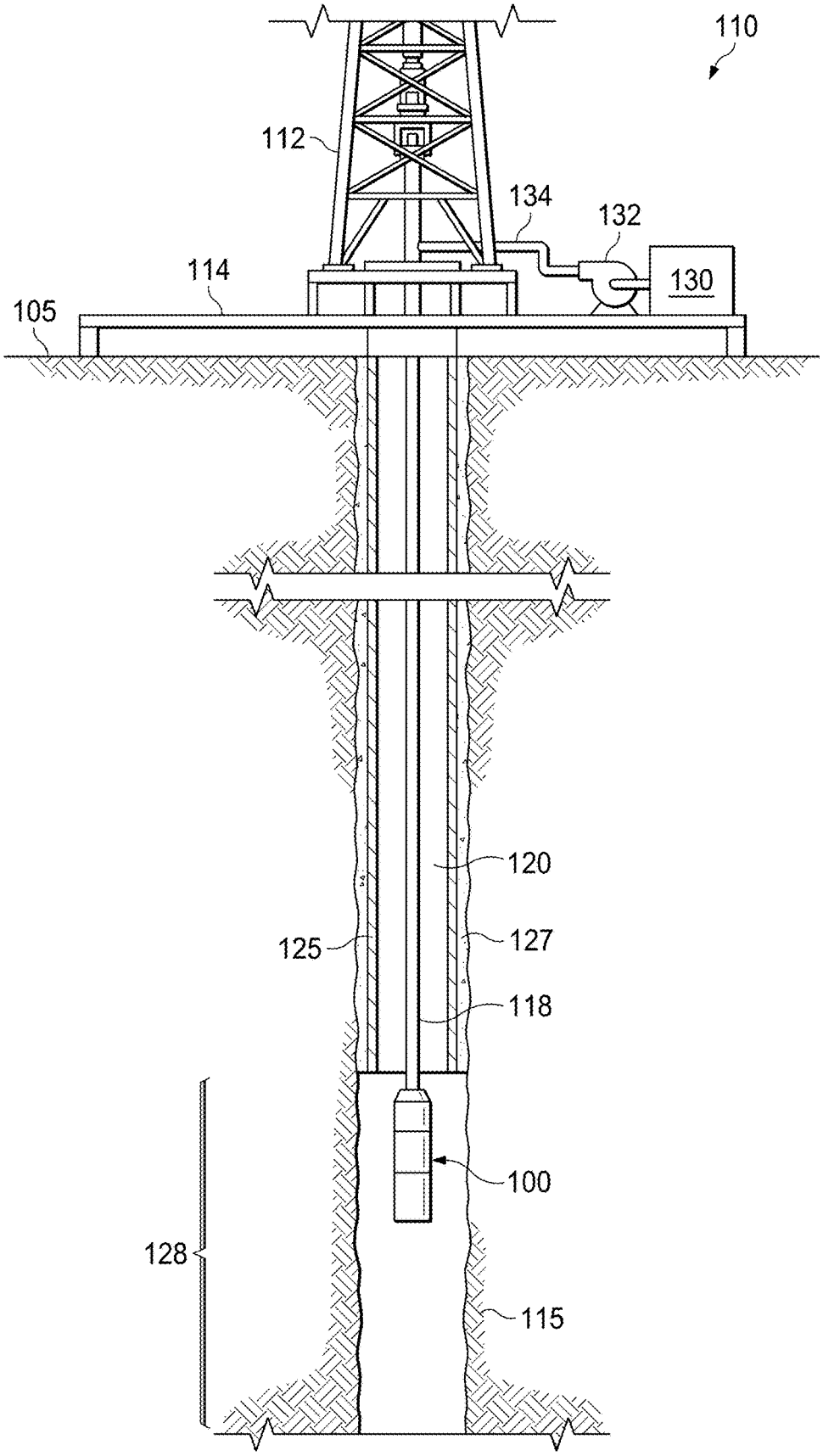
FIG. 1 illustrates an operating environment for a tool including a swellable metal, in accordance with examples of the present disclosure.

The present disclosure relates to creating a swellable metal packer that swells in the presence of carbon dioxide rather than with water or oil. The result is a sealing and anchoring system that provides a permanent and safe solution for storing $CO_2$ underground. The swellable packer may include a metal (including metal alloys) that may react with the $CO_2$ from the CCUS. The $CO_2$ chemically transforms the metal into a hydrated-metal-carbonate (HMC). The HMC is similar to metal hydroxides in that there is a chemical reaction that causes the material to expand. The hydrated-metal carbonate forms a metal-carbonate material rather than only a metal-hydroxide material.

In some examples, the $CO_2$ may be part of the wellbore fluid that causes the metal expansion. The presence of $CO_2$ results in a final product that is more than a metal hydroxide. The final product is a single type or a combination of several different hydrated-metal-carbonates. The $CO_2$ results in the formation of HMCs (expansion of the metal), and humidity or additional water content facilitates the chemical reaction. In some examples, carbon monoxide may be used rather than $CO_2$.

The expansion of metal is caused by a chemical reaction (e.g., via a wellbore fluid) that converts the metal into a metal oxide or metal hydroxide, and with $CO_2$ incorporation, the metal oxide or metal hydroxide transforms into an HMC, with a corresponding expansion of the solid phase of the material. As noted above, the chemical reaction is facilitated with the wellbore fluid such as water, especially brine. For example, magnesium converts/corrodes to magnesium hydroxide (Mg to $Mg(OH)_2$) in the presence of water. Other metals include aluminum, zinc, silicon, calcium, and iron. The metal differs from the metal oxide in that the metal is shiny, lustrous, conductive, and malleable.

The metal can be alloyed to change the strength or the reaction speeds. For example, copper, iron, or nickel can be used accelerate the reaction speed. In some examples, the metal may be made from extrusion, powder metallurgy, forging, or casing. The metal may be mixed with a polymer. The extent of HMC formation depends on several parameters such as for example, porosity of initially formed metal hydroxide, temperature, humidity level, $CO_2$ concentration, pressure, and/or timing and duration of $CO_2$ infusion (e.g., introduction of $CO_2$ to the metal or contact of the $CO_2$ with the metal).

In some examples, the $CO_2$ may be added to the wellbore fluids prior to the initial setting (expansion) of the packer, during the setting of the packer, or after the setting phase of the packer. Adding $CO_2$ after an initial water-set results in a seal with reduced permeability and increased strength. The seal may include a bridge plug, vee packing, a seal gland, and/or a packing seal. The carbon dioxide injection into the well which contains the metal, results in permanent $CO_2$ storage due to mineralization of the byproducts of the chemical reaction. Additionally, reaction of the metal with the $CO_2$ reduces porosity of the final product, resulting in improved mechanical properties for the packer, such as a higher differential pressure capacity.

This disclosure describes the formation of a series of final products other than metal hydroxide ($Mg(OH)_2$) in expanding metal technology, due to inclusion of carbon dioxide ($CO_2$) in the wellbore fluid. When $CO_2$ is incorporated into the fluid (e.g., brine, water), metal hydroxide (such as $Mg(OH)_2$) is formed from the metal (such as Mg) and water. Then, the metal hydroxide further reacts to yield a range of hydrated metal carbonates (HMCs).

The formation of HMCs expands the rock-like material beyond the volume of the metal hydroxide. The carbonate process is an expansive process which reduces the porosity and enhances the sealing and anchoring performance of the packer. The carbonate process may include the following reactions (e.g., Equations (1)-(6)) that result in HMCs.

$$Mg+H_2O \rightarrow MgO+H_2 \quad (1)$$

$$MgO+H_2O \rightarrow Mg(OH)_2 \quad (2)$$

$$Mg(OH)_2+CO_2+2H_2O \rightarrow MgCO_3 \cdot 3H_2O \text{(Nesquehonite)} \quad (3)$$

$$2Mg(OH)_2+CO_2+2H_2O \rightarrow Mg_2CO_3(OH)_2 \cdot 3H_2O \text{(Artinite)} \quad (4)$$

$$5Mg(OH)_2+4CO_2 \rightarrow Mg_5(CO_3)+(OH)_2 \cdot 4H_2O \text{(Hydromagnesite)} \quad (5)$$

$$5Mg(OH)_2+4CO_2+H_2O \rightarrow Mg_5(CO_3)+(OH)_2 \cdot 5H_2O \text{(Dypingite)} \quad (6)$$

Equations (1) and (2) illustrate conversion of a metal to a metal hydroxide (e.g., corrosion of metal in presence of water). Equations (3) to (6) illustrate conversion of the metal hydroxide to different HMCs (e.g., Nesquehonite, Artinite, Hydromagnesite, and/or Dypingite) due to $CO_2$. For example, a solid Mg alloy is first corroded with water to form $Mg(OH)_2$ and then further reacted with $CO_2$ to produce HMCs. The HMCs provide compressive strengths several times higher than that of $Mg(OH)_2$. Although Mg is shown in the Equations, it should be noted that any suitable metal may be used.

A source of the $CO_2$ and/or CO (carbon monoxide) may include captured and stored $CO_2$/CO that is emitted from industrial activities. In some examples, the CO may be used in addition to the $CO_2$ or to replace the $CO_2$. The $CO_2$/CO may be in a liquid, a gas, or in a supercritical state. Introduction of the $CO_2$/CO may be performed at multiple stages of the well lifecycle. In some examples, the $CO_2$/CO infusion occurs while the metal is reacting with the downhole fluid (e.g., water). This may result in dissolution of the $CO_2$/CO in the water to form carbonic acid, which may accelerate transformation of the metal to the HMC.

In other examples, the $CO_2$/CO infusion occurs after the downhole fluid is removed from the well. The $CO_2$/CO infusion may occur seconds, minutes, hours, or even years after the downhole fluid is removed. In another example, the $CO_2$/CO may already be present in the well and the metal packer may be placed into the wellbore with existing $CO_2$/CO for infusion to occur. In another example, the $CO_2$/CO is created downhole. The $CO_2$/CO can result from a chemical reaction, such as an acid reacting with a carbonate during wellbore cleanup.

FIG. 1 illustrates a well system 110 (operating environment) for a downhole tool 100, in accordance with examples of the present disclosure. In some examples, the downhole tool 100 may include a bridge plug, vee packing, a seal gland, and/or a packing seal. A derrick 112 with a rig floor 114 is positioned on the earth's surface 105. A wellbore 120 is positioned below the derrick 112 and the rig floor 114 and extends into a subterranean formation 115. The wellbore 120 may be lined with casing 125 that is cemented in place with cement 127. Although FIG. 1 depicts the wellbore 120 having a casing 125 being cemented into place with cement 127, the wellbore 120 may include open hole portion 128. Moreover, the wellbore 120 may be an open-hole wellbore. The well system 110 may equally be employed in vertical and/or deviated wellbores.

A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. In some examples, the downhole tool 100 may be hydraulically pumped into the wellbore 120. The downhole tool 100 may include any type of wellbore zonal isolation device including, but not limited to, a frac plug, a bridge plug, a packer, a wiper plug, or a cement plug. The well system 110 may also include a fluid source 130 (e.g., a tank including $CO_2$ or water/brine or CO), a pump 132, and conduit 134 for directing the fluid into the wellbore 120. The fluid may be pumped/injected into the well to activate the tool 100 (e.g., swell a packer).

A source of the $CO_2$/CO may include captured and stored $CO_2$/CO that is emitted from industrial activities. The $CO_2$/CO may be in a liquid, a gas, or in a supercritical state. Introduction of the $CO_2$/CO may be performed at multiple stages of the well lifecycle. In some examples, the $CO_2$/CO infusion occurs while the tool/metal is reacting with a wellbore fluid (e.g., water). This may result in dissolution of the $CO_2$/CO in the wellbore fluid to form carbonic acid, which may accelerate transformation of the metal to the HMC.

Figure 2:
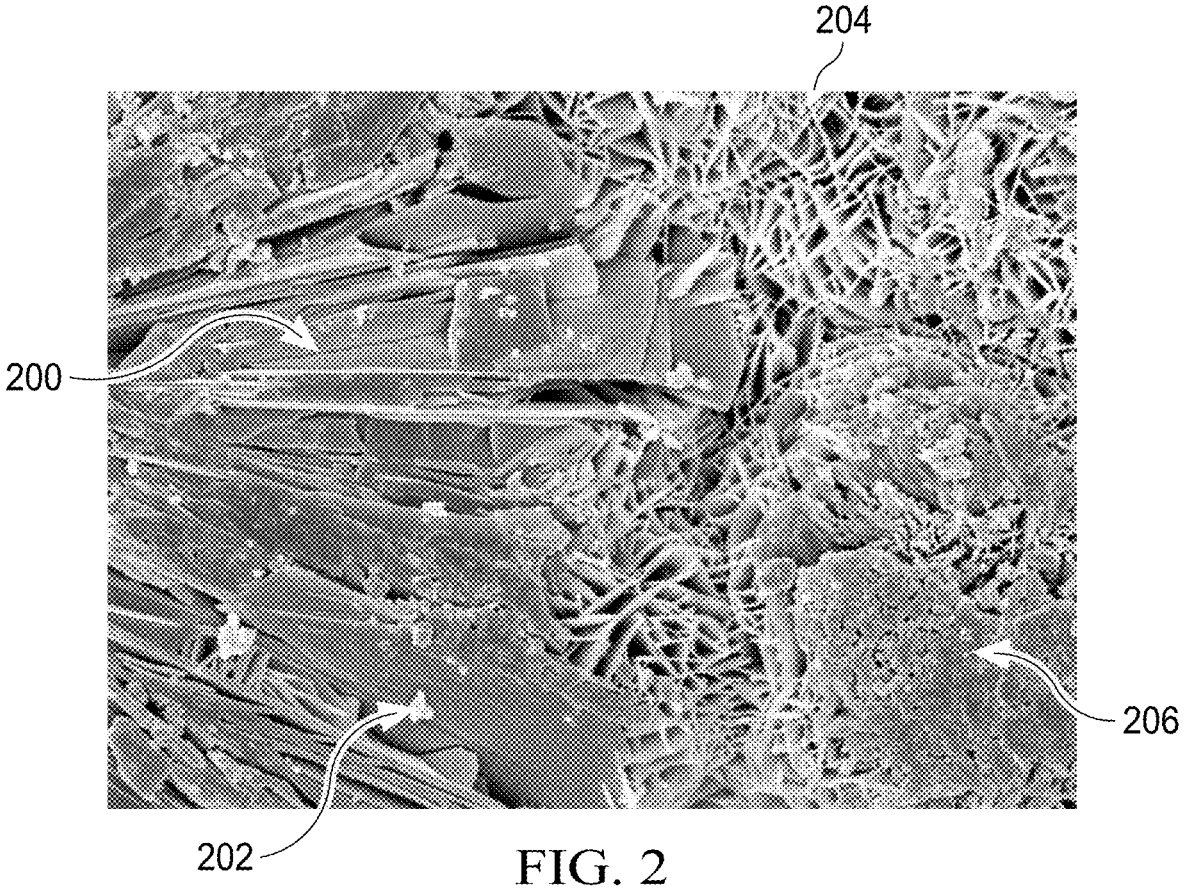
FIG. 2 illustrates a close-up view of hydrated-metal-carbonates (HMCs), in accordance with examples of the present disclosure.

FIG. 2 illustrates scanning electron microscopy (SEM) images of various HMCs, in accordance with examples of the present disclosure. The image includes various HMCs such as for example: HMC 200 (e.g., Nesquehonite), HMC 202 (e.g., Artinite), HMC 204 (e.g., Hydromagnesite), and HMC 206 (e.g., Dypingite). These HMCs cause an overall increase in original/initial size (e.g., expansion of initial diameter) of the packer.

Figure 3:
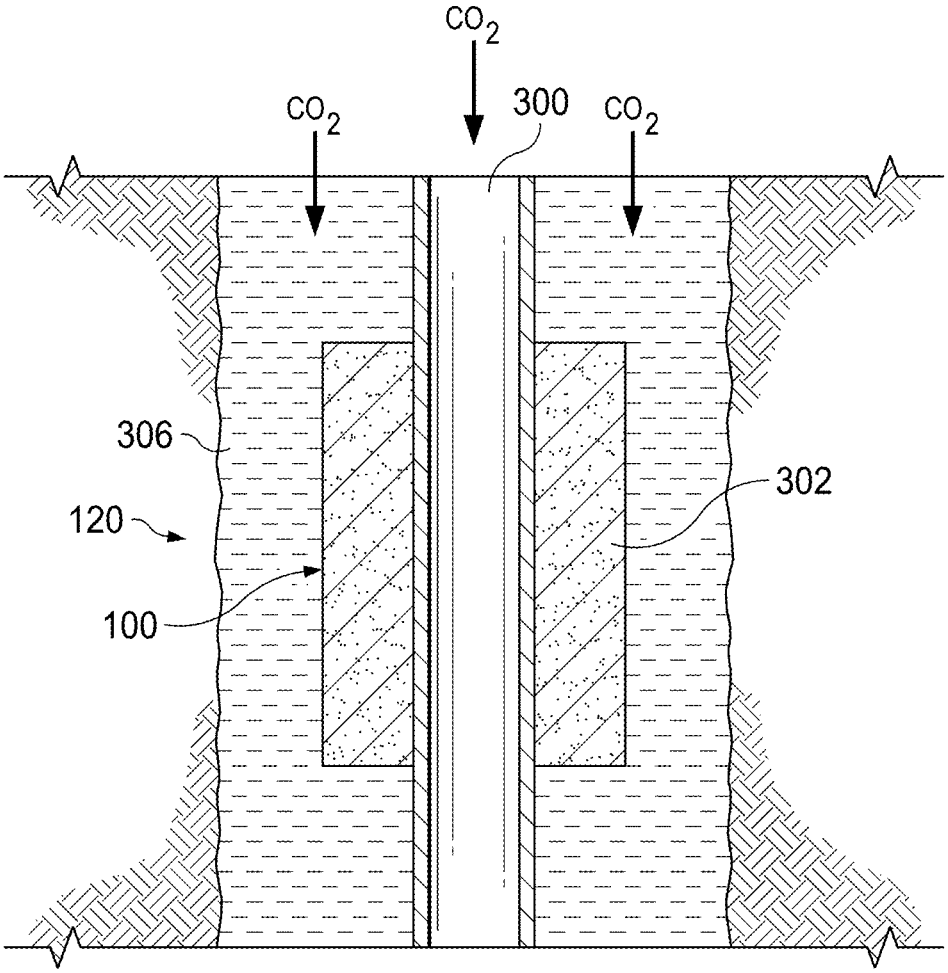
FIG. 3 illustrates the tool in an unexpanded state, in accordance with examples of the present disclosure.

FIG. 3 illustrates a close-up view of the tool 100 in an unactuated state (e.g., packer not set), in accordance with examples of the present disclosure. The tool 100 may be or include a swellable packer. The tool 100 may be disposed around a mandrel 300. The tool 100 may include metal 302 such as for example, magnesium, aluminum, cessium, zinc, silicon, calcium, and/or iron. The metal 302 may be an alloy to change the strength or the reaction speeds. For example, copper, iron, tungsten, or nickel may be used to accelerate the reaction speed. In some examples, the metal may be made from extrusion, forging, or casing. The metal 302 may be mixed with a polymer. The extent of HMC formation depends on several parameters such as for example, porosity of initially formed metal hydroxide, temperature, humidity level, $CO_2$/CO concentration, pressure, and/or timing and duration of the $CO_2$/CO infusion (e.g., contact with metal).

The $CO_2$/CO may be introduced into the wellbore 120 to contact the metal 302 and react with the metal 302 while the metal 302 is submerged in wellbore fluid 306 such as water (e.g., brine). The CO/CO may be injected down a tool string or down the casing, for example. As noted above, the chemical reaction is facilitated with water, especially brine.

In some examples, adding $CO_2$/CO after an initial water-set results in a seal with reduced permeability and increased strength. The $CO_2$/CO injection into the well (wellbore 120) which contains the metal 302, results in permanent $CO_2$/CO storage due to mineralization of the byproducts of the chemical reaction. Additionally, reaction of the metal with the $CO_2$/CO reduces porosity of the final product, resulting in improved mechanical properties for the tool 100 (packer), such as a higher differential pressure capacity.

Figure 4:
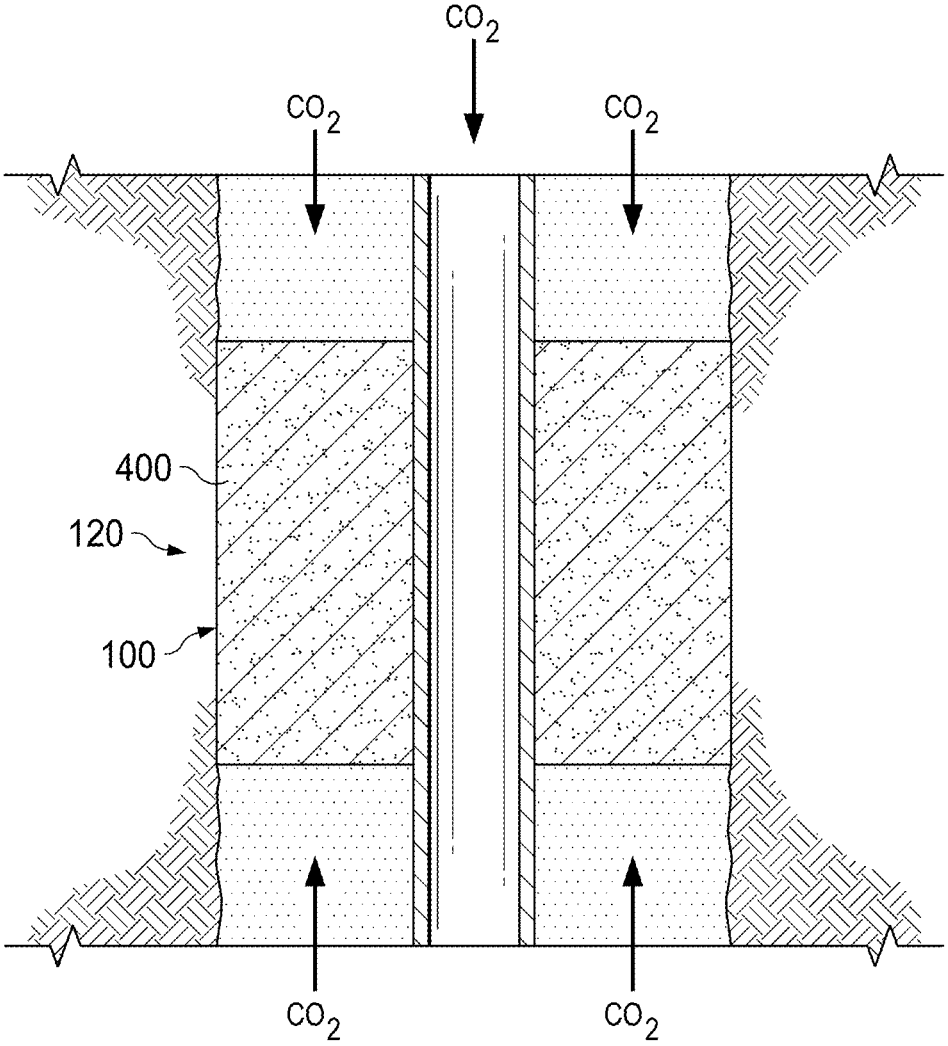
FIG. 4 illustrates the tool in an expanded state, in accordance with examples of the present disclosure.

FIG. 4 illustrates the wellbore 120 after the tool 100 has set/expanded in accordance with examples of the present disclosure. HMCs 400 has formed on the tool 100 causing it to increase in size/expand and plug the wellbore 120 which may be cased or open-hole. The injected $CO_2$/CO removes (e.g., displaces) the fluid that was in the wellbore 120. As noted above, Equations (1) and (2) illustrate conversion of a metal to a metal hydroxide, and Equations (3) to (6) illustrate conversion of the metal hydroxide to different HMCs (e.g., Nesquehonite, Artinite, Hydromagnesite, and/or Dypingite). For example, a solid metal alloy of the tool 100, such as magnesium is first corroded with a wellbore fluid including water, to form Mg(OH), that is further reacted with the $CO_2$/CO to produce the HMCs 400. The HMCs 400 provide compressive strengths several times higher than that of $Mg(OH)_2$.

Figure 5:
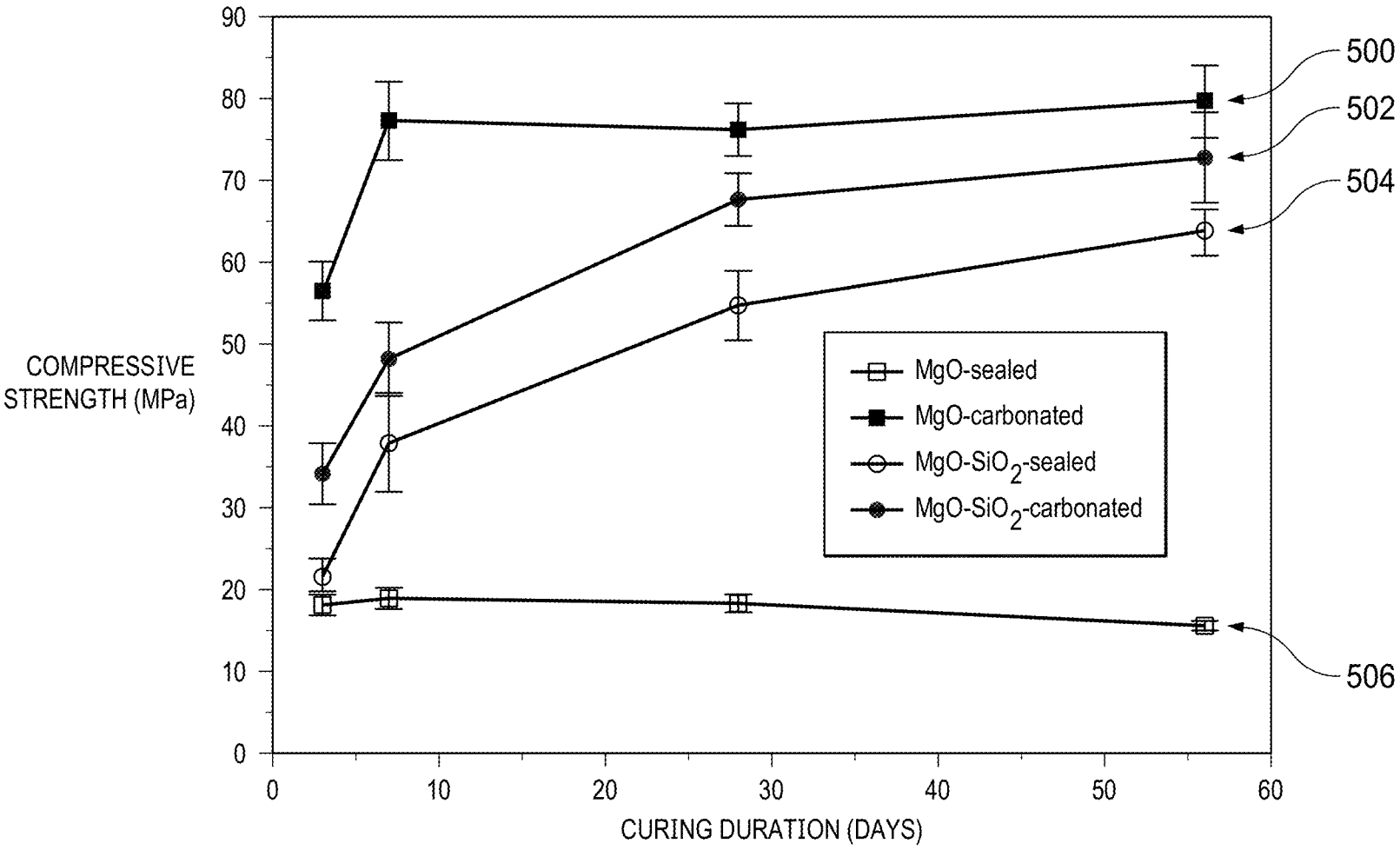
FIG. 5 illustrates comparisons of compressive strengths of carbonated MgO-based concrete blocks vs. non-carbonated MgO-based concrete blocks, in accordance with examples of the present disclosure.

FIG. 5 compares the compressive strength of carbonated MgO-based concrete blocks 500 vs. non-carbonated MgO-based concrete blocks 506, and carbonated MgO—$SiO_2$-based concrete blocks 502 vs. non-carbonated MgO—$SiO_2$-based concrete blocks 504. The carbonated MgO concrete blocks 500 reach compressive strengths around 78 MPa within 7 days, while the compressive strength of non-carbonated MgO-based concrete blocks 506 remain around 18 MPa. In addition to being 4× stronger at final setting, the magnesium carbonate achieved higher strength early in the setting process. The effect of carbonation is demonstrated in this example, where the enhancement of compressive strength was attributed to the formation of HMCs and the associated decrease in the overall porosity due to HMCs formation. $CO_2$/CO infusion also blocks pores in the concrete to reduce permeability. Incorporation of $SiO_2$ makes carbonated MgO—$SiO_2$-based concrete blocks 502 and non-carbonated MgO—$SiO_2$-based concrete blocks 504 a totally different cementitious system whose strength gain relies mostly on hydration. Nevertheless, inclusion of carbonation for MgO—$SiO_2$-based concrete blocks 502 improves the compressive strength about 15-50% at all durations in comparison to non-carbonated MgO—$SiO_2$-based concrete blocks 504.

Figure 6:
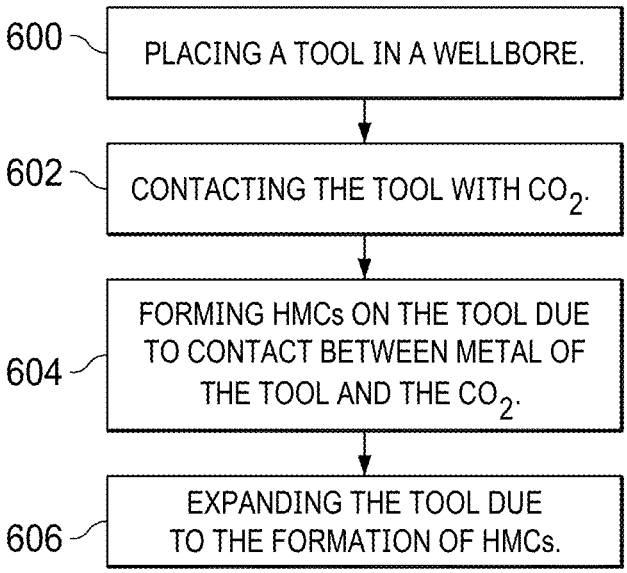
FIG. 6 illustrates an operative sequence for expansion of the tool due to a formation of the HMCs, in accordance with examples of the present disclosure.

FIG. 6 illustrates an operative sequence for expanding a tool in a wellbore, in accordance with examples of the present disclosure. At step 600, a tool is placed into the wellbore (e.g., see FIG. 1). The tool may include a swellable metal packer that is configured to swell/expand upon contacting $CO_2$/CO (e.g., see FIG. 3). The tool may include metal such as for example, magnesium, aluminum, zinc, silicon, calcium, and/or iron. The metal may be an alloy to change the strength or the reaction speeds. For example, copper, iron, or nickel may be used to accelerate the reaction speed. In some examples, the metal may be made from extrusion, forging, or casing. The metal may be mixed with a polymer.

At step 602, the tool may be contacted with the $CO_2$/CO (e.g., see FIGS. 3 and 4). For example, the $CO_2$/CO may be injected into the wellbore to contact the metal and react with $CO_2$/CO while the metal is submerged in wellbore fluid such as water (e.g., brine). As noted above, the chemical reaction is facilitated with water, especially brine. For example, magnesium converts to magnesium hydroxide (Mg to $Mg(OH)_2$). Other metals include aluminum, zinc, silicon, calcium, and iron. The metal can be alloyed to change the strength or the reaction speeds. For example, copper, iron, or nickel can be used accelerate the reaction speed. In some examples, the metal may be made from extrusion, forging, or casing. The metal 302 may be mixed with a polymer.

In some examples, adding $CO_2$/CO after an initial water-set results in a seal with reduced permeability and increased strength. The $CO_2$/CO injection into the well (wellbore) which contains the metal, results in permanent $CO_2$/CO storage due to mineralization of the byproducts of the chemical reaction. Additionally, reaction of the metal with the $CO_2$/CO reduces porosity of the final product, resulting in improved mechanical properties for the tool (packer), such as a higher differential pressure capacity.

At step 604, HMCs form on the tool (e.g., see FIGS. 2 and 4). The extent of HMC formation depends on several parameters such as for example, porosity of initially formed metal hydroxide, temperature, humidity level, $CO_2$/CO concentration, pressure, and/or timing and duration of $CO_2$/CO infusion. Equations 1 through 6 show exemplary chemical reactions resulting in the HMCs. FIG. 2 illustrates different non-limiting examples of HMCs including Nesquehonite, Artinite, Hydromagnesite, and Dypingite. In some examples, the wellbore fluid may be removed with the $CO_2$/CO. For example, the $CO_2$/CO displaces the wellbore fluid out of the wellbore (e.g., into a subterranean formation). At step 606, the tool is expanded due to formation of the HMCs (e.g., see FIG. 4). Expansion of the tool may seal the well to contain the $CO_2$/CO underground.

Accordingly, the systems and methods of the present disclosure allow for activation of metal seals with $CO_2$/CO to store the $CO_2$/CO underground. The systems and methods may include any of the various features disclosed herein, including one or more of the following statements.

Statement 1. A method comprises contacting a tool with carbon dioxide ($CO_2$) and or carbon monoxide (CO), the tool comprising metal: forming hydrated metal carbonates (HMCs) on the tool due to contact of the $CO_2$ and/or the CO with the metal of the tool; and expanding a size and/or reducing a porosity of the tool due to formation of the HMCs.

Statement 2. The method of the statement 1, wherein the tool is disposed in a wellbore.

Statement 3. The method of the statement 1 or the statement 2, wherein the wellbore includes water.

Statement 4. The method of any one of the statements 1-3, further comprising sealing a well with at least the HMCs, the tool disposed in the well.

Statement 5. The method of any one of the statements 1-4, further comprising containing the $CO_2$ and/or the CO in a subterranean formation with the HMCs.

Statement 6. The method of any one of the statements 1-5, further comprising removing wellbore fluid from a wellbore with the $CO_2$ and/or the CO, the tool disposed in the wellbore.

Statement 7. The method of any one of the statements 1-6, wherein HMCs of different chemical compositions are formed on the tool.

Statement 8. A method comprising: disposing a tool in a wellbore, the tool comprising metal: corroding the metal with a fluid of the wellbore to provide corroded metal; contacting the corroded metal with carbon dioxide ($CO_2$) and/or CO: forming hydrated metal carbonates (HMCs) on the tool due to contact of the $CO_2$ and/or the CO with the corroded metal: and expanding a size and/or reducing a porosity of the tool due to formation of the HMCs.

Statement 9. The method of the statement 8, further comprising plugging the wellbore with the tool due to formation of the HMCs.

Statement 10. The method of the statement 8 or 9, wherein the fluid includes water.

Statement 11. The method of any one of the statements 8-10, further comprising containing the $CO_2$ and/or the CO in a subterranean formation with the HMCs.

Statement 12. The method of any one of the statements 8-11, wherein HMCs of different chemical compositions are formed on the tool.

Statement 13. The method of any one of the statements 8-12, further comprising removing the fluid of the wellbore with the $CO_2$ and/or the CO, the tool disposed in the wellbore.

Statement 14. The method of any one of the statements 8-13, wherein the fluid of the wellbore comprises water.

Statement 15. A system comprising: a source in fluid communication with a well, the source configured to provide carbon dioxide ($CO_2$) and/or CO to the well: and a tool disposed in the well, the tool configured to form hydrated metal carbonates (HMCs) upon contact with the $CO_2$ and/or the CO.

Statement 16. The system of any one of the statements 13-15, wherein the HMCs include HMCs of different chemical compositions.

Statement 17. The system of any one of the statements 13-16, wherein the well includes a wellbore fluid configured to corrode the tool.

Statement 18. The system of any one of the statements 13-17, wherein the wellbore fluid includes water.

Statement 19. The system of any one of the statements 13-18, wherein the tool comprises the HMCs.

Statement 20. The system of any one of the statements 13-19, wherein the HMCs are configured to increase a size and/or reduce a porosity of the tool.

Statement 21. A downhole tool comprising a portion configured to define a plug with formed hydrated metal carbonates (HMCs), the HMCs configured to form on the portion, and expand a size and/or reduce a porosity of the downhole tool, upon exposure of the downhole tool to $CO_2$ and/or CO.

Statement 22. The downhole tool of the statement 21, wherein the downhole tool is positioned in a wellbore to receive the $CO_2$ and/or the CO.

Statement 23. The downhole tool of the statement 21 or 22, wherein the HMCs include HMCs with different chemical compositions.

Statement 24. The downhole tool of any one of the statements 21-23, wherein the portion extends along a circumference of the downhole tool.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising." "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

lowering a tool in a wellbore, wherein the tool comprises a swellable metal packer that expands upon contacting carbon dioxide ($CO_2$) and/or carbon monoxide (CO), wherein the metal of the swellable metal packer is a metal, and wherein the metal of the swellable metal packer is selected from the group of metals consisting of magnesium, aluminum, cesium, zinc, silicon, calcium, iron, and any combination thereof, and wherein the wellbore comprises a brine;

contacting the metal of the swellable metal packer with the brine and forming a metal hydroxide;

injecting carbon dioxide ($CO_2$) and/or carbon monoxide (CO) into the wellbore;

contacting the metal hydroxide of the swellable metal packer with the carbon dioxide ($CO_2$) and/or carbon monoxide (CO);

forming hydrated metal carbonates (HMCs) from a chemical reaction between the metal hydroxide of the metal of the swellable metal packer with the $CO_2$ and/or CO contacting the swellable metal packer, wherein each hydrated metal carbonate comprises a plurality of water molecules bonded to the metal carbonate;

expanding a size and/or reducing a porosity of the swellable metal packer due to formation of the HMCs; and displacing a wellbore fluid from the wellbore into a subterranean formation by injecting $CO_2$ and/or CO while the tool is disposed in the wellbore.

2. The method of claim 1, wherein the tool is disposed in the wellbore.

3. The method of claim 1, further comprising sealing a well with at least the HMCs, the tool disposed in the well.

4. The method of claim 1, further comprising containing the $CO_2$ and/or the CO in a subterranean formation with the HMCs.

5. The method of claim 1, wherein HMCs of different chemical compositions are formed on the tool.

6. A method comprising:

disposing a tool in a wellbore, the tool comprising a swellable metal packer comprising metal that expands upon contacting carbon dioxide ($CO_2$) and/or carbon monoxide (CO), wherein the metal of the swellable metal packer is a metal and wherein the metal is selected from the group of metals consisting of magnesium, aluminum, cesium, zinc, silicon, calcium, iron, and any combination thereof;

injecting a mix of brine and carbon dioxide ($CO_2$) and/or carbon monoxide (CO) into the wellbore;

corroding the metal with a fluid of the wellbore to provide corroded metal comprising metal hydroxide;

forming hydrated metal carbonates (HMCs) on the tool due to contact of the $CO_2$ and/or the CO with the corroded metal, wherein each hydrated metal carbonate comprises a plurality of water molecules bonded to the metal carbonate;

expanding a size and/or reducing a porosity of the swellable metal packer of the tool due to formation of the HMCs; and displacing a wellbore fluid from the wellbore into a subterranean formation by injecting $CO_2$ and/or CO while the tool is disposed in the wellbore.

7. The method of claim 6, further comprising plugging the wellbore with the tool due to formation of the HMCs.

8. The method of claim 6, wherein the fluid of the wellbore includes water.

9. The method of claim 6, further comprising containing the $CO_2$ and/or the CO in a subterranean formation with the HMCs.

10. The method of claim 6, wherein HMCs of different chemical compositions are formed on the tool.

11. The method of claim 6, wherein the fluid of the wellbore comprises brine.

* * * * *